US005715962A

United States Patent [19]

McDonnell

[11] Patent Number: 5,715,962

[45] Date of Patent: Feb. 10, 1998

[54] EXPANDABLE ICE CHEST

[76] Inventor: Sandra J. McDonnell, 4211 Nations Dr., Pasadena, Tex. 77505

[21] Appl. No.: 558,668

[22] Filed: Nov. 16, 1995

[51] Int. Cl.[6] ..... B65D 6/26

[52] U.S. Cl. ..... 220/4.03; 220/410; 220/8

[58] Field of Search ..... 220/4.03, 4.26, 220/408, 410, 8

[56] References Cited

U.S. PATENT DOCUMENTS

| | | | |
|---|---|---|---|
| 803,966 | 11/1905 | Barnes . | |
| 968,633 | 8/1910 | Andrews . | |
| 1,015,455 | 1/1912 | Neesham | 220/8 |
| 1,827,396 | 10/1931 | Luckett . | |
| 2,877,505 | 3/1959 | Stephens | 220/8 |
| 3,791,547 | 2/1974 | Branscum | 220/408 |
| 3,980,198 | 9/1976 | Baumgarten | 220/8 |
| 4,724,976 | 2/1988 | Lee | 220/8 |
| 5,016,753 | 5/1991 | Henderson | 206/459 |
| 5,020,337 | 6/1991 | Krieg | 62/464 |
| 5,170,934 | 12/1992 | Lemoine | 229/101 |
| 5,192,019 | 3/1993 | Meehan | 229/101 |
| 5,314,046 | 5/1994 | Pedrini | 190/105 |

OTHER PUBLICATIONS

"Sporting Goods for Today's Lifestyles," Rubbermaid, 1994.

"Igloo's Big on Fun!", 1994 Igloo Product Catalog and Price List, 1993, pp. 1–36.

"1994 Outdoor Products Catalog," The Coleman Company, 1993, pp. 32–63.

*Primary Examiner*—Stephen J. Castellano

*Attorney, Agent, or Firm*—Pravel, Hewitt, Kimball & Krieger

[57] ABSTRACT

An expandable ice chest including a base member having a first pair of opposing walls, a second pair of opposing walls, and a bottom surface. The first and second pairs of opposing walls are attached to the bottom surface to form a box-like receptacle having an open upper end. An adjustable inner liner has a first pair of opposing liner walls and a second pair of opposing liner walls. The first pair of opposing liner walls are connected to the second pair of opposing liner walls. The adjustable inner liner has an open lower end and is slidably engaged within the base member. A lid member is received on the adjustable inner liner. A seal is positioned between the inner liner and the base member. The inner liner is adjustably secured to the base member in a plurality of positions via a slot through the base member and a pocket in the inner liner. A plug is received in the pocket and the slot to secure the relative position of the inner liner to the base member.

14 Claims, 4 Drawing Sheets

FIG. 4
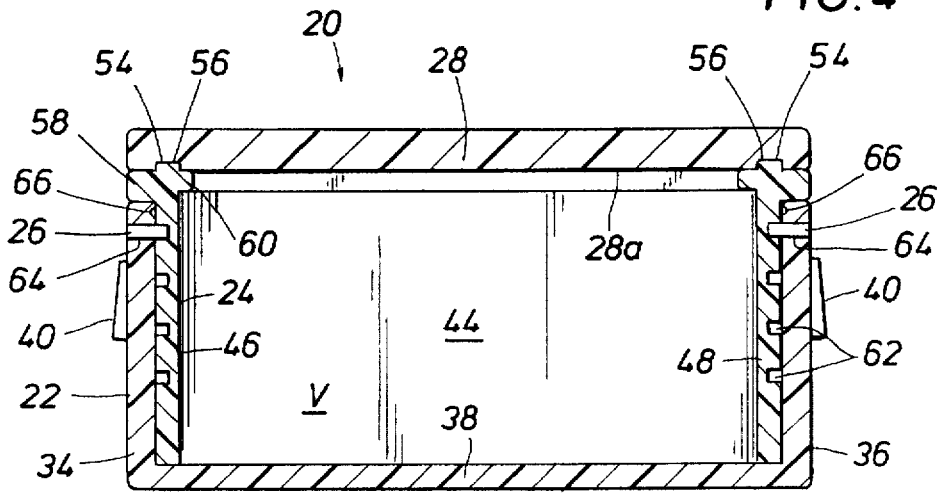
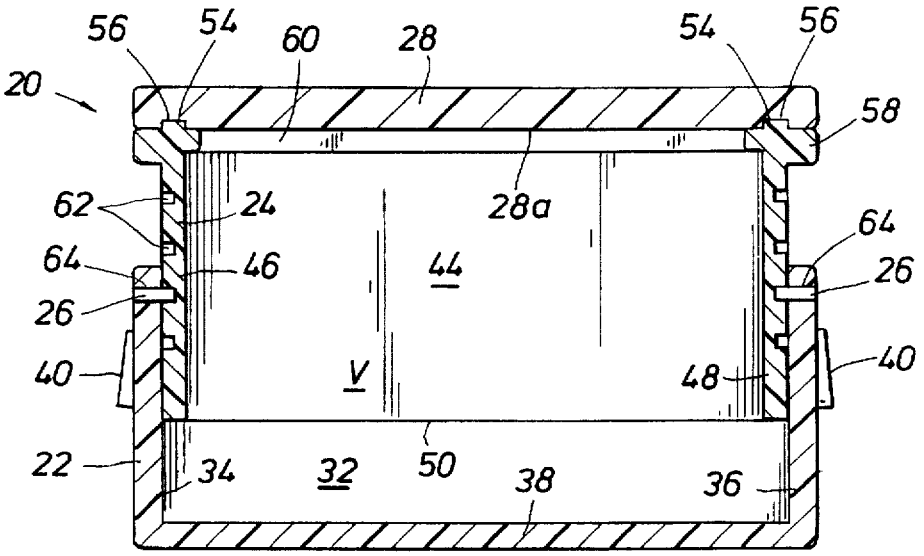
FIG. 5
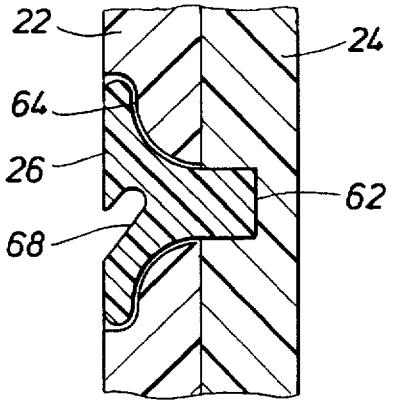
FIG. 6

FIG. 13
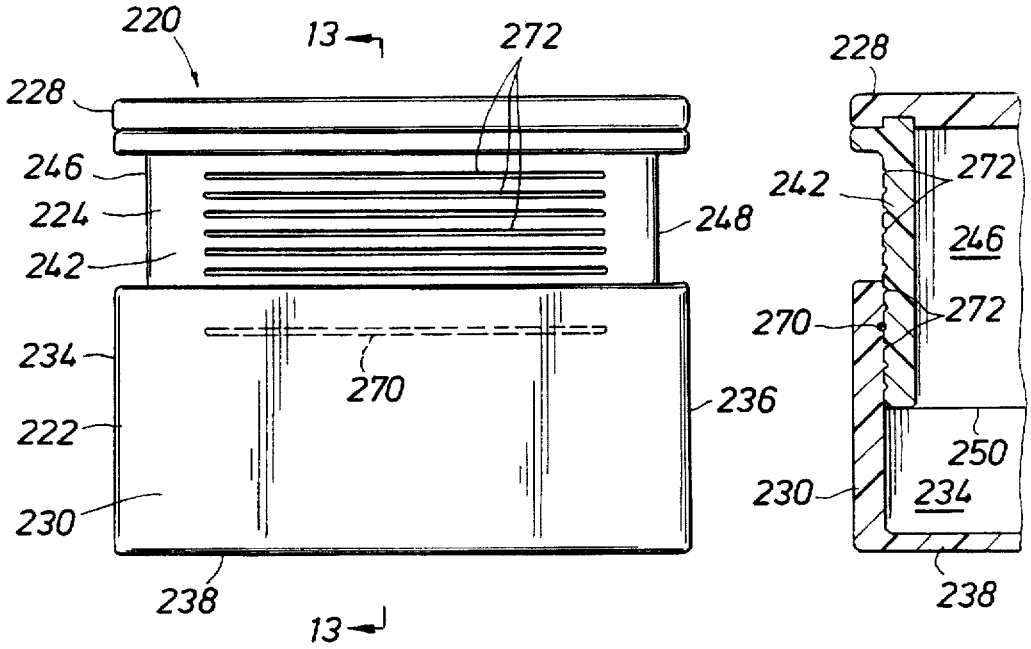
FIG. 12
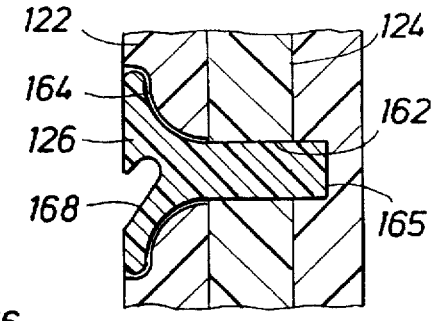
FIG. 10
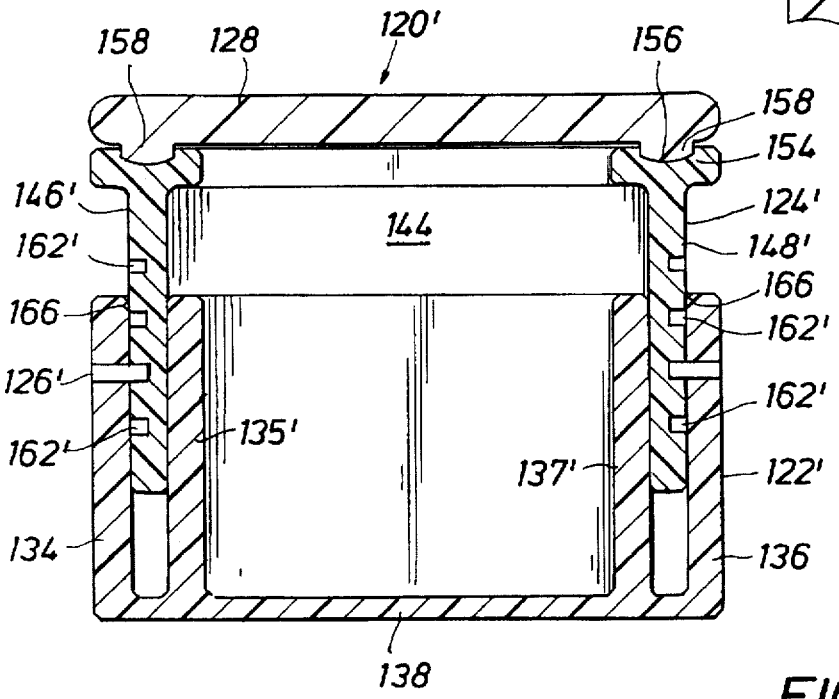
FIG. 11

EXPANDABLE ICE CHEST

BACKGROUND OF THE INVENTION

1. Field of the Invention

The present invention relates to ice chests and coolers, and more particularly to portable ice chests and coolers for outdoor use.

2. Description of the Prior Art

It has long been known to use various portable ice receptacles to keep food and drinks cool while being away from power sources and refrigeration. Portable ice receptacles, hereinafter referred to as ice chests, are available today in many various shapes, sizes and types of construction.

For over 30 years, portable ice chests made of plastic have been widely manufactured and sold. Typically, plastic ice chests are insulated with a foam such as a polyurethane foam. Portable plastic ice chests are lightweight, durable and effective at maintaining food and drinks at a cool temperature.

One of the problems consumers face today when purchasing an ice chest is the size or capacity of the ice chest. Typically, once the consumer decides on a particular style of ice chest, he may then have to choose between as many as five to eight different sizes. The consumer has different size requirements depending on the type of event or outing the consumer is taking. For example, one size of ice chest may be fine for a small picnic lunch, however, the same ice chest will be too small for a two day camping trip.

U.S. Pat. Nos. 5,020,337 to Krieg and 5,170,934 to Lemoine disclose disposable types of expandable ice chests.

It is desirable to have an ice chest which is expandable so that its capacity can be altered depending on the user's needs. It is desirable that the expandable ice chest be well insulated and re-usable. It is also desirable that the expandable ice chest be sturdy, durable, lightweight, economical and easy to use.

SUMMARY OF THE INVENTION

The expandable ice chest of the present invention is expandable so that its capacity can be altered depending on the user's needs. The expandable ice chest is well insulated and re-usable. It is also sturdy, durable, lightweight, economical and easy to use.

The expandable ice chest has an adjustable inner liner which can be extended relative to a base member of the ice chest. The base member may be of single- or double-wall construction. A pair of plugs or pins are received in elongated slots through the base member for achieving the desired size of ice chest. In another embodiment, a friction fit between the inner liner and the base member maintains the expandable ice chest in the desired size. A lid for the ice chest may be hinged to the adjustable inner liner or be totally removable. The expandable ice chest can be manufactured in various sizes and shapes.

BRIEF DESCRIPTION OF THE DRAWINGS

In order to more fully understand the drawings referred to in the detailed description of the present invention, a brief description of each drawing is presented, in which:

FIG. 4 is an elevational sectional view of the expandable ice chest shown in FIG. 3;

FIG. 5 is a view similar to FIG. 4 and showing the expandable ice chest in an expanded position;

FIG. 6 is an elevational sectional view showing the plug adjustment assembly of the first embodiment of the expandable ice chest;

FIG. 10 is an elevational sectional view showing the plug adjustment assembly of the second embodiment of the expandable ice chest;

FIG. 11 is a view similar to FIG. 9 and showing a third embodiment of the expandable ice chest shown in FIGS. 1 and 2;

FIG. 12 is a front elevational view of a fourth embodiment of the expandable ice chest in an expanded position; and FIG. 13 is a partial sectional view taken along line 13—13 of FIG. 12.

DETAILED DESCRIPTION OF PREFERRED EMBODIMENT

Figure 1:
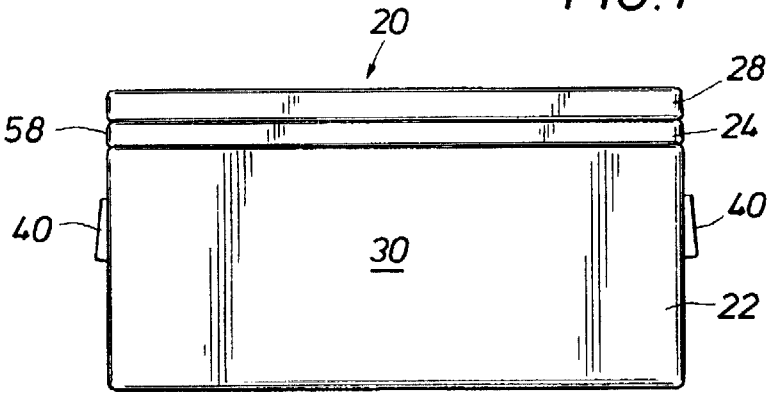
FIG. 1 is a front elevational view of the expandable ice chest according to the present invention.
Figure 2:
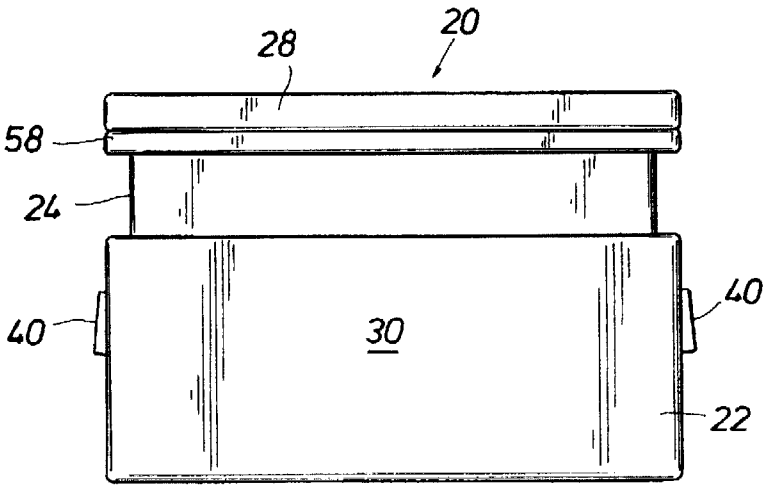
FIG. 2 is a view similar to FIG. 1 and showing the expandable ice chest in an expanded position.

Referring now to the drawings, wherein like numerals indicate like parts, FIGS. 1 and 2 show an expandable ice chest, generally designated by the numeral 20. It is to be understood that the size and shape of the expandable ice chest 20 is illustrated as a rectangular box-shape for illustrative purposes, although the expandable ice chest 20 according to the present invention could also be manufactured in various other shapes and sizes, for example, a cylindrical shape.

FIG. 1 shows the expandable ice chest 20 in a retracted position whereas FIG. 2 shows the ice chest 20 in an expanded position.

Referring to FIGS. 1–5, the expandable ice chest 20 includes a base member 22, an adjustable inner liner 24, one or more plugs 26 and a lid 28. The base member 22 includes front and rear walls 30 and 32, respectively, left and right side walls 34 and 36, respectively, and bottom 38. Preferably, the front and rear walls 30 and 32, respectively, are substantially parallel to each other and the left and right side walls 34 and 36, respectively, are also substantially parallel to each other. Referring to FIGS. 1, 2, 4 and 5, a pair of handles 40 are attached to the side walls 34 and 36.

Preferably, the base member 22 is made of a high impact plastic which is filled with insulation, such as polyurethane foam insulation.

The adjustable inner liner 24 includes front and rear walls 42 and 44, respectively, and left and right side walls, 46 and 48 respectively. Preferably the front and rear walls 42 and 44, respectively, are substantially parallel to each other and the left and right side walls 46 and 48, respectively, are also substantially parallel to each other. The adjustable inner liner 24 is open at its lower end 50.

As shown in FIGS. 4 and 5, the adjustable inner liner 24 is sized to snugly and slidably be received within the base member 22. Referring to FIGS. 4 and 5, preferably a sealing gasket 66 extends around the inner periphery of the base member 22. The sealing gasket 66 forms a substantially air tight and fluid tight seal between the adjustable inner liner 24 and the base member 22. Preferably, the sealing gasket 66 is located near the upper end of the base member 22.

The lid 28 is adapted to form a tight seal with the open upper end 52 of the adjustable inner liner 24. Referring to FIGS. 1, 2, 4 and 5, one type of tight fitting lid assembly is shown. The lid 28 includes a substantially peripheral recess 54 around the lower face 28*a* of the lid 28. A mating projection 56 extends upwardly from the adjustable inner liner 24. Referring to FIGS. 4 and 5, the adjustable inner liner 24 includes an outwardly extending peripheral shoe 58 and an inwardly extending peripheral bead 60. The shoe 58 provides a gripping area to expand the expandable ice chest 20 and also provides additional sealing area with the lid 28. The bead 60 also provides additional sealing area with the lid 28. It is to be understood that various other sealing arrangements are contemplated and within the scope of the present invention.

Figure 3:
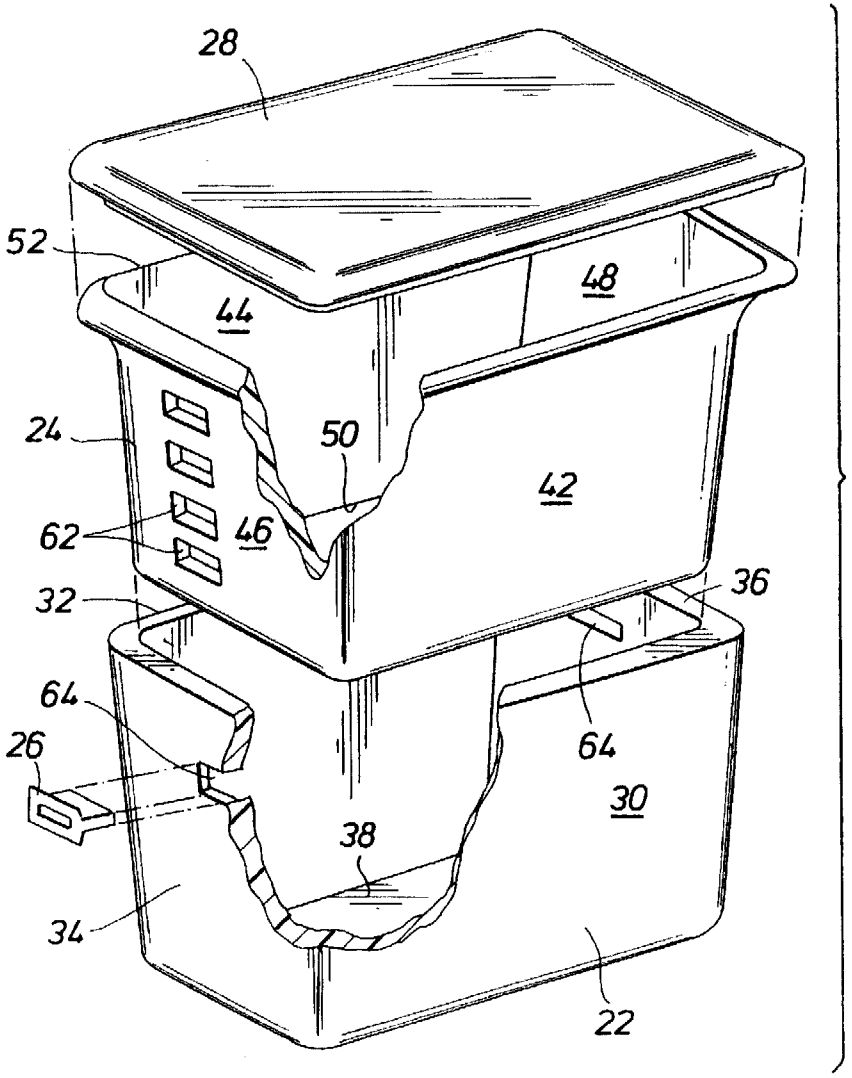
FIG. 3 is an exploded perspective view of a first embodiment of the expandable ice chest shown in FIGS. 1 and 2.

As shown in FIG. 3, the lid 28 is removable from the adjustable inner liner 24. It is to be understood that the lid 28 can also be hinged to the adjustable inner liner 24. Such hinges for ice chest lids are well known in the art.

Referring to FIGS. 3–5, the adjustable inner liner 24 includes a plurality of plug pockets 62. Preferably, the plug pockets 62 are on opposing walls of the adjustable inner liner 24. The plug pockets 62 are arranged vertically in the side walls 46 and 48.

Still referring to FIGS. 3–5, the side walls 34 and 36 of the base member 22 include a plug slot 64 extending therethrough. The plug slots 64 are positioned in the base member 22 so as to be in vertical alignment with the plug pockets 62 when the adjustable inner liner 24 is inserted within the base member 22.

Referring to FIGS. 4 and 5, the plugs 26 extend through the side walls 34 and 36 of the base member 22 and into the aligned plug pockets 62. The plugs 26 are inserted into the corresponding pair of plug pockets 62 based upon the desired size of the ice chest 20. As shown in FIGS. 4 and 5, the expandable ice chest 20 may be four different sizes. It is to be understood that the number of different sizes of the expandable ice chest 20 can be varied by the manufacturer.

The plugs 26 maintain the expandable ice chest 20 at the desired size. Various types of plugs 26 may be used to secure the adjustable inner liner 24 to the base member 22. One preferred embodiment of plug 26 is shown in FIGS. 3 and 6. Referring to FIGS. 3 and 6, the plug 26 includes a finger recess 68 to aid in the removal of the plug 26 from the plug slot 64 and plug pocket 62. Preferably, the plug 26 is flush with the outer surface of the base member 22 when installed as shown in FIG. 6. This eliminates the possibility of the plug 26 snagging objects and being inadvertently broken or removed during usage.

Figure 8:
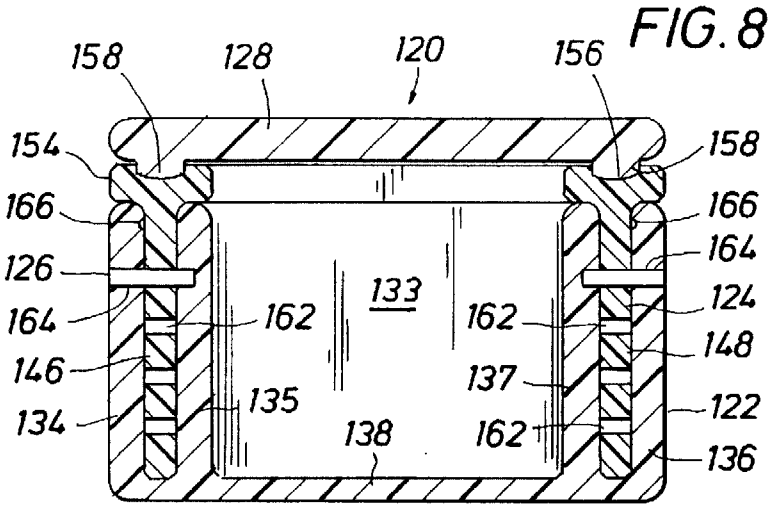
FIG. 8 is an elevational sectional view of the expandable ice chest shown in FIG. 7.
Figure 9:
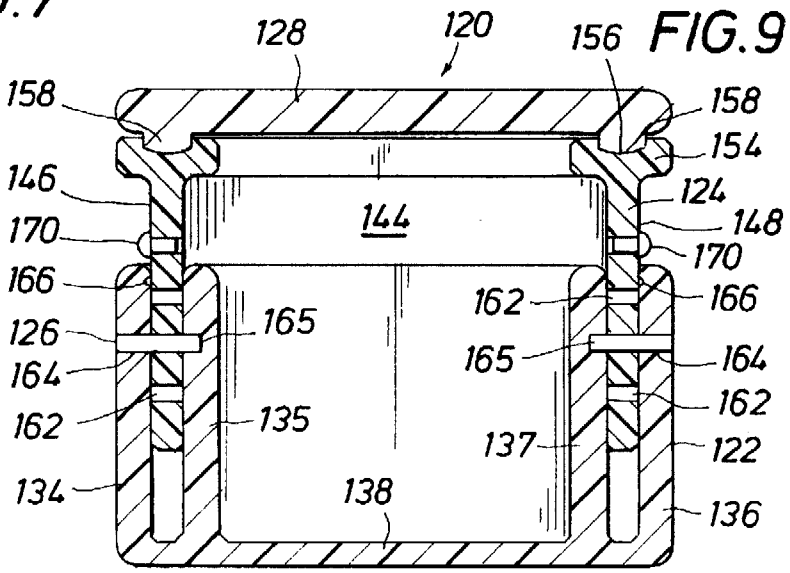
FIG. 9 is a view similar to FIG. 8 and showing the expandable ice chest in an expanded position.
Figure 7:
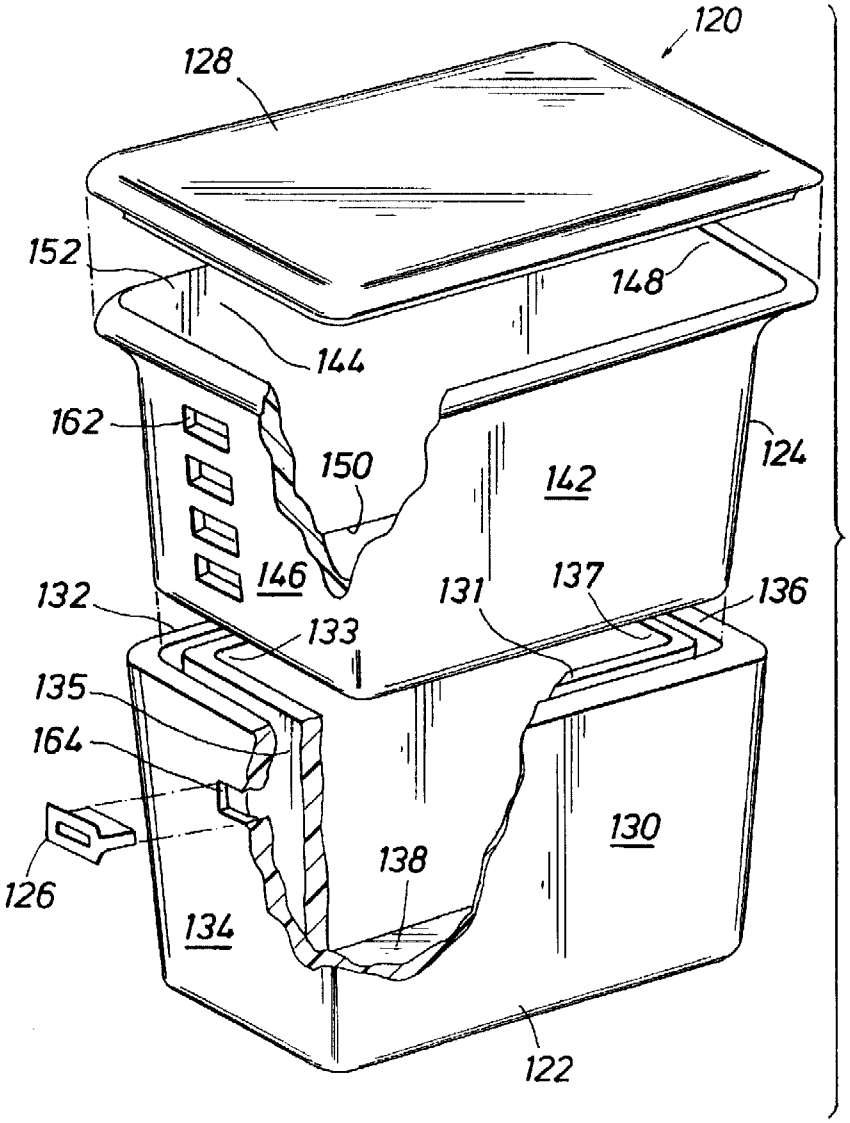
FIG. 7 is an exploded perspective view of a second embodiment of the expandable ice chest shown in FIGS. 1 and 2.

Referring to FIGS. 7–9, a second embodiment of the expandable ice chest, generally designated by the numeral 120, is shown.

Referring to FIGS. 7–9, the expandable ice chest 120 includes a base member 122, an adjustable inner liner 124, one or more plugs 126 and a lid 128. The base member 122 includes front and rear outer walls 130 and 132, respectively, front and rear inner walls 131 and 133, respectively, left and right side outer walls 134 and 136, respectively, left and right side inner walls 135 and 137, respectively, and bottom 138. Preferably, the front and rear walls 130, 131, 132 and 133 are substantially parallel to one another and the left and right side walls 134, 135, 136 and 137 are also substantially parallel to one another. As shown in FIGS. 7–9, the base member 122 of the expandable ice chest 120 is a double wall construction for reasons which will be explained below.

Although not shown in FIGS. 7–9, preferably a pair of handles are attached to the side outer walls 134 and 136 of the base member 122 as shown for the first embodiment of the expandable ice chest 20.

Preferably, the base member 122 is made of a high impact plastic which is filled with insulation, such as polyurethane foam insulation.

The adjustable inner liner 124 includes front and rear walls 142 and 144, respectively, and left and right side walls, 146 and 148 respectively. Preferably the front and rear walls 142 and 144, respectively, are substantially parallel to each other and the left and right side walls 146 and 148, respectively, are also substantially parallel to each other. The adjustable inner liner 124 is open at its lower end 150.

As shown in FIGS. 8 and 9, the adjustable inner liner 124 is sized to snugly and slidably be received within the double wall base member 122. Referring to FIGS. 8 and 9, preferably a sealing gasket 166 extends around the inner periphery of the outer walls 130, 132, 134 and 136 of the base member 122. The sealing gasket 166 forms a substantially air tight and fluid right seal between the adjustable inner liner 124 and the base member 122. Preferably, the sealing gasket 166 is located near the upper end of the base member 122.

The lid 128 is adapted to form a tight seal with the open upper end 152 of the adjustable inner liner 124. Referring to FIGS. 7–9, one type of tight fitting lid assembly is shown. The adjustable inner liner 124 includes an upper flange 154 having an upwardly facing peripheral recess 156. A mating projection 158 extends downwardly from the lid 128. Referring to FIGS. 8 and 9, the upper flange 154 of the adjustable inner liner 124 has a width approximating the width of the inner and outer walls of the double wall base member 122. The upper flange 154 provides a gripping area to expand the expandable ice chest 120 and also provides additional sealing area with the lid 128. It is to be understood that various other sealing arrangements and lid assemblies are contemplated and within the scope of the present invention.

As shown in FIG. 7, the lid 128 is removable from the adjustable inner liner 124. It is to be understood that the lid 128 can also be hinged to the adjustable inner liner 124. Such hinges for ice chest lids are well known in the art.

Referring to FIGS. 7–9, the adjustable inner liner 124 includes a plurality of plug openings 162. Preferably, the plug openings 162 are on opposing walls of the adjustable inner liner 124. The plug openings 162 are arranged vertically in the side walls 146 and 148. The plug openings 162 in the adjustable inner liner 124 of the expandable ice chest 120 extend through the side walls 146 and 148.

Still referring to FIGS. 7–9, the side outer walls 134 and 136 of the base member 122 include a plug slot 164 extending therethrough. The plug slots 164 are positioned in the base member 122 so as to be in vertical alignment with the plug openings 162 when the adjustable inner liner 124 is inserted within the base member 122. Referring to FIGS. 8 and 9, the side inner walls 135 and 137 include plug recesses 165 for receiving the plugs 126.

Referring to FIGS. 8–10, the plugs 126 extend through the side walls 134 and 136 of the base member 122 and through the aligned plug openings 162 and into the plug recesses 165. The plugs 126 are inserted through the corresponding pair of plug openings 162 based upon the desired size of the expandable ice chest 120. As shown in FIGS. 8 and 9, the expandable ice chest 120 may be four different sizes. It is to be understood that the number of different sizes of the expandable ice chest 120 can be varied by the manufacturer.

The plugs 126 maintain the expandable ice chest 120 at the desired size. Various types of plugs 126 may be used to secure the adjustable inner liner 124 to the base member 122. One preferred embodiment of plug 126 is shown in FIGS. 7 and 10. Referring to FIG. 10, the plug 126 includes a finger recess 168 to aid in the removal of the plug 126 from the plug slot 164, plug opening 162 and plug recess 165. Preferably, the plug 126 is flush with the outer surface of the base member 122 when installed as shown in FIG. 10. This eliminates the possibility of the plug 126 snagging objects and being inadvertently broken during usage.

Depending on the number of adjustment sizes and the location of the plug openings 162, it may be necessary to have plug inserts 170 to fill exposed plug openings 162. Referring to FIG. 9, pairs of plug inserts 170 are provided to be inserted into the exposed plug openings 162 when the expandable ice chest 120 is in an expanded position exposing the plug openings 162. The plug inserts 170 are removed from the plug openings 162 when the adjustable inner liner 124 is retracted in the base member 122 as shown in FIG. 8. It is possible that one or more adjustment sizes could be provided without exposing the plug openings 162 in which case the plug inserts 170 would be unnecessary.

Referring to FIG. 11, a slight variation of the expandable ice chest 120 is shown and referenced generally as 120'. The differences between the expandable ice chests 120 and 120' involve the plug adjustment feature. Referring FIG. 11, the adjustable inner liner 124' includes a plurality of plug pockets 162'. Preferably, the plug pockets 162' are on opposing walls of the adjustable inner liner 124'. The plug pockets 162' are arranged vertically in the side walls 146' and 148'. Preferably, the plug pockets 162' do not extend through the side walls 146' and 148'. The side inner walls 135' and 137' of the base member 122' do not include plug recesses for receiving the plugs 126' as described above for the previous embodiment shown in FIGS. 8 and 9.

Referring to FIG. 11, the plugs 126' extend through the side walls 134 and 136 of the base member 122' and into the aligned plug pockets 162'. The plugs 126' are inserted into the corresponding pair of plug pockets 162' based upon the desired size of the ice chest 120'.

Referring to FIGS. 12 and 13, a fourth embodiment of the expandable ice chest, generally designated by the numeral 220, is shown. The expandable ice chest 220 includes a base member 222, an adjustable inner liner 224, and a lid 228. The base member 222 includes a front wall 230, a rear wall (not shown), left and right side walls 234 and 236, respectively, and bottom 238. Preferably, the front wall 230 and rear wall are substantially parallel to each other and the left and right side walls 234 and 236, respectively, are also substantially parallel to each other. Although not shown, it is to be understood that a pair of handles are attached to the side walls 234 and 236.

Preferably, the base member 222 is made of a high impact plastic which is filled with insulation, such as polyurethane foam insulation.

The adjustable inner liner 224 includes a front wall 242, a rear wall (not shown), and left and right side walls, 246 and 248 respectively. Preferably, the front wall 242 and rear wall are substantially parallel to each other and the left and right side walls 246 and 248, respectively, are also substantially parallel to each other. The adjustable inner liner 224 is open at its lower end 250.

As shown in FIGS. 12 and 13, the adjustable inner liner 224 is sized to snugly and slidably be received within the base member 222. Referring to FIGS. 12 and 13, preferably a replaceable sealing gasket 270 extends along a portion of the inner surface of the base member 222. It is to be understood that the sealing gasket 270 could extend continuously around the inner periphery of the base member 222 or be placed only on the side walls or only on a portion of the front and rear walls. Preferably, the sealing gasket 270 is located near the upper end of the base member 222.

The inner liner 224 has a plurality of shallow indentations 272 which allow the sealing gasket 270 to hold the inner liner 224 in place for use of the ice chest 220 at any one of a plurality of heights by simply sliding the inner liner 224 up and down in relation to the base member 222, catching the sealing gasket 270 in the shallow indentations 272. The friction created by the sealing gasket 270 and the pressure of the inner liner 224 on the base member 222 holds the inner liner 224 in the desired position.

It is to be understood that alternatively the sealing gasket 270 could be located on the outer surface of the inner liner 224 near the lower end 250 and the shallow indentations 272 in the base member 222.

The lid 228 is adapted to form a tight seal with the open upper end of the adjustable inner liner 224 in the same manner as described for the previous embodiments.

The advantages of the various embodiments of the expandable ice chests 20, 120, 120', and 220 will now be discussed. Certainly, all of the expandable ice chests 20, 120, 120', and 220 allow for a single ice chest to cover a range of sizes or volumes. The expandable ice chests 20, 120, 120', and 220 can easily provide expansion in the range of approximately 50–85% above that of the retracted expandable ice chest to give a wide range of applicability. Such versatility has not been accomplished before. When the desired size is small, the ice chest is in the retracted position and when the required size is greater the adjustable liner is positioned accordingly. The adjustment of the ice chest is quickly and easily performed from the outside of the ice chest. The expandable ice chests 20, 120, 120', and 220 are rugged, durable and lightweight. The expandable ice chests 20, 120, 120', and 220 include carrying handles attached to the base member 22, 122, 122', or 222 which permit the ice chests to be carried in the normal manner without any possibility of disengaging the adjustable inner liner 24, 124, 124', or 224 or overstressing the plugs 26, 126 or 126'. Although not shown, it is also possible to attach wheels to the base member to make a rolling expandable ice chest.

The expandable ice chests 20, 120 and 120' are sturdy. Frequently during usage of an ice chest, a significant amount of weight may rest on the lid and be supported by the ice chest. The expandable ice chest can also be made to support a significant amount of weight. The weight-bearing capacity of the expandable ice chest 20, 120 and 120' can be increased in various ways. For example, increasing the shear strength or shear area of the plugs 26, 126 or 126' or the quantity of plugs will serve to increase the weight-bearing capacity of the ice chests. The double wall base member 122 with the plugs 126 extending through the adjustable inner liner 124 as shown in FIGS. 8 and 9 provides a high weight-bearing capacity design.

It is to be understood that the expandable ice chest 20, 120 and 120' could be made to expand to one additional size, two additional sizes or other and is not limited to the three additional sizes as illustrated in the drawings. Referring to FIG. 13, the ice chest 220 shown is adjustable to a number of various sizes. It is also to be understood that the expandable ice chests can be adjusted in size at any time with contents in the ice chest. There is no need to empty to ice chest in order to adjust its size.

The foregoing disclosure and description of the invention are illustrative and explanatory thereof, and various changes in the size, shape and materials, as well as in the details of the illustrated construction may be made without departing from the spirit of the invention.

What is claimed is:

1. An expandable ice chest comprising:

a base member having a first pair of opposing walls, a second pair of opposing walls, and a bottom surface, said first and second pairs of opposing walls attached to said bottom surface to form a box-like receptacle having an open upper end;

a liner having a first pair of opposing liner walls and a second pair of opposing liner walls, said first pair of opposing liner walls connected to said second pair of opposing liner walls, said liner having an open lower end;

wherein said liner is slidably engaged within said base member;

a lid member received on said liner;

a seal means positioned between said liner and said base member; and means for adjustably securing and maintaining said liner relative to said base member in a plurality of positions, said adjustably securing and maintaining means flush-mounted with said base member and externally controlled.

2. The ice chest of claim 1, wherein said means for adjustably securing and maintaining comprises:

a slot through said base member;

a pocket in said liner, said pocket capable of being adjacently aligned with said slot; and a plug received in said pocket and said slot to secure the relative position of said liner to said base member.

3. The ice chest of claim 1, wherein said first pair of opposing walls are substantially parallel to each other and said second pair of opposing walls are substantially parallel to each other, and wherein said first pair of opposing liner walls are substantially parallel to each other and said second pair of opposing liner walls are substantially parallel to each other.

4. The ice chest of claim 1, further comprising a pair of handles attached to said base member.

5. An expandable ice chest comprising:

a base member having a first pair of opposing walls, a second pair of opposing walls, and a bottom surface;

a removable liner having a first pair of opposing liner walls and a second pair of opposing liner walls, said liner having an open lower end;

wherein said liner is slidably engaged within said base member;

a lid member received on said liner; and means for adjustably securing said liner relative to said base member in a plurality of positions, wherein said means for adjustably securing comprises:

a slot through said base member:

a pocket in said liner, said pocket capable of being adjacently aligned with said slot; and a detachable plug received in said pocket and said slot to secure the relative position of said liner to said base member, said detachable plug capable of detaching from said base member.

6. The ice chest of claim 5, wherein said liner includes a plurality of pockets capable of being aligned with said slot.

7. The ice chest of claim 5, wherein said plug includes a finger recess therein.

8. An expandable ice chest comprising:

a base member having a first pair of opposing walls, a second pair of opposing walls, and a bottom surface;

a liner having a first pair of opposing liner walls and a second pair of opposing liner walls;

wherein said liner is slidably engaged within said base member;

a lid member received on said liner; and means for adjustably securing said liner relative to said base member in a plurality of positions, wherein said means for adjustably securing comprises:

a slot through said base member;

a pocket in said liner, said pocket capable of being adjacently aligned with said slot; and a plug received in said pocket and said slot to secure the relative position of said liner to said base member, said plug fitting flush against said base member.

9. The ice chest of claim 8, wherein said plug includes a finger recess therein.

10. The ice chest of claim 8, wherein said liner includes a plurality of pockets capable of being aligned with said slot.

11. The ice chest of claim 8, further comprising a seal means between said liner and said base member.

12. The ice chest of claim 8, wherein said first pair of opposing walls are substantially parallel to each other and said second pair of opposing walls are substantially parallel to each other, and wherein said first pair of opposing liner walls are substantially parallel to each other and said second pair of opposing liner walls are substantially parallel to each other.

13. The ice chest of claim 8, further comprising a pair of handles attached to said base member.

14. The ice chest of claim 8, wherein said liner includes an exterior gripping portion for adjusting said liner relative to said base member.

* * * * *